US007251909B2

(12) United States Patent
Gameiro

(10) Patent No.: US 7,251,909 B2
(45) Date of Patent: Aug. 7, 2007

(54) CONVERTIBLE CHAIR AND IRONING BOARD

(76) Inventor: Jack Gameiro, 527 Olive Pl., Woodbridge, NJ (US) 07095

( * ) Notice: Subject to any disclaimer, the term of this patent is extended or adjusted under 35 U.S.C. 154(b) by 0 days.

(21) Appl. No.: 11/430,584

(22) Filed: May 9, 2006

(65) Prior Publication Data

US 2006/0260154 A1 Nov. 23, 2006

Related U.S. Application Data

(60) Provisional application No. 60/683,445, filed on May 23, 2005.

(51) Int. Cl.
*D06F 81/00* (2006.01)
*A47C 1/00* (2006.01)
*D06F 83/00* (2006.01)

(52) U.S. Cl. ..... 38/112; 297/118

(58) Field of Classification Search ..... 38/104, 38/106, 107, 112, 139; 297/120, 124, 118
See application file for complete search history.

(56) References Cited

U.S. PATENT DOCUMENTS 1,207,469 A * 12/1916 Banas ..... 297/120
1,359,723 A * 11/1920 Mohammed ..... 297/120
1,719,004 A * 7/1929 Eos ..... 182/33.2
1,744,437 A * 1/1930 Benk ..... 297/124
2,024,960 A * 12/1935 Allerding ..... 182/29

* cited by examiner

*Primary Examiner*—Ismael Izaguirre
(74) *Attorney, Agent, or Firm*—Ezra Sutton

(57) ABSTRACT

A convertible chair and ironing board apparatus for transforming a straight-back chair into an ironing board. The apparatus includes a chair having front legs and rear legs for supporting a chair seat thereon. The apparatus also includes a back support section for receiving a back support member thereon. The back support member is pivotally connected to the back support section about a pair of back support pivot members so that the back support member can rotatably pivot 270° from a vertical position as a back support for the chair to a horizontal position to function as an ironing board. The chair seat has a movable seat section that is pivotally connected to the chair seat about a pair of seat pivot members, and the seat section is movable from a horizontal seat position about the seat pivot members to a vertical support position for supporting a lower section of the back support member in a horizontal position to function as an ironing board.

20 Claims, 7 Drawing Sheets

CONVERTIBLE CHAIR AND IRONING BOARD

RELATED APPLICATION

Applicant has filed a Provisional Application Ser. No. 60/683,445 on May 23, 2005.

FIELD OF THE INVENTION

The present invention relates to a convertible chair and ironing board apparatus that transforms a chair assembly into an ironing board. This combined chair and ironing board apparatus and serves as straight-back chair and is easily converted for use as an ironing board.

BACKGROUND OF THE INVENTION

Combined chair and ironing board devices are well-known in the prior art. For most people, household chores are a fact of life. Vacuuming debris from carpeting, polishing furniture, waxing floors and cleaning windows are necessary tasks which must be done regularly to ensure a healthy and clean household. In particular, most consumers wash laundry on a regular basis. While many clothing and accessory items such as blue jeans, sweat shirts, socks, towels and bed linens can simply be tossed into the dryer, folded, and put away after being laundered, there are many items which require further care. Specifically, most dress items such as skirts, blouses, shirts and pants, as well we many casual goods, must be carefully ironed in order to smooth away wrinkles and give the item a neat and professional look. An often dreaded task, pressing clothing requires the use of a standard, electric iron and most importantly, an ironing board. Ironing boards are extremely useful devices configured specifically to facilitate the ironing process. Conveniently elevated and contoured to conform to the shape of collars and waistbands, ironing boards are necessary items found in most households.

While there is little dispute that ironing boards are necessary and practical accessories, there are some drawbacks associated with their use. Specifically, most ironing boards are constructed to be collapsible, thus folding flat for easy storage. Unfortunately, it is this very benefit which can hamper use of an ironing board. Simply stated, many consumers find that the folding legs of an ironing board are simply not sturdy enough to support the weight of clothing spread across the top of the board, and thus the board often wobbles off balance during use. Not surprisingly, the heavier the garment or the more clothing piled atop the board, the more unstable the board becomes. Should the user put too much weight on the board, or should the board become too unbalanced, it can easily topple over and fall, often creating quite a mess.

There remains a need for a convertible chair and ironing board apparatus which would offer the user a practical solution to the aforementioned problems. The foregoing apparatus would be specifically designed to transform a straight-back chair that is easily converted and transformable into a fully functioning and extremely stable ironing board. The apparatus would include a frame having a back support section for pivotally holding a back support member, such that the back support member pivots relative to the back support section from a vertical position to a horizontal position in a 270° rotation about back support pivot points for converting the back support member to a functioning ironing board. The straight back chair would also include a chair seat member having a movable seat section being movable from a horizontal position to a vertical position in a 90° rotation about seat pivot points to serve as a support member in order to hold a lower section of the back support member in the horizontal plane relative to the floor to function as an ironing board. Additionally, the chair seat member of the straight back chair would include a storage compartment located under the chair seat.

DESCRIPTION OF THE PRIOR ART

Combined chair and ironing board, and combination ironing board, stepladder, chair and other furniture of various designs, configurations, structures and materials of construction have been generally disclosed in the prior art. For example, U.S. Pat. No. 5,883,306 to BRETO discloses a chair assembly transformable into a table, a bar and an ironing table. The chair assembly includes a pivotable board forming a backrest which pivotally moves from a vertical position to a horizontal position for converting to an ironing table. The chair assembly also includes a pivotable panel forming a seat for the chair assembly which pivotally moves from a horizontal position to a vertical position for converting to a support member in order to hold the ironing table in its horizontal position. Also, the chair assembly in another embodiment includes storage containers underneath the seat. This prior art patent does not disclose or teach the design, structure and configuration of the improved convertible chair and ironing board apparatus of the present invention.

U.S. Pat. No. 1,703,981 to ARMSTRONG et al. Disclosed a combination ironing board and chair, such that the chair frame converts to an ironing board. The chair frame includes an ironing board used as a backrest, a seat board and a pair of bracing bars. The ironing board is movable from its vertical position to a horizontal position and the seat board holds the ironing board in its horizontal position. The seat board is pivotally movable from its horizontal position to a vertical position. The bracing bars, armrests, and front legs cooperate with each other to form a bracing structure for holding the seat board in its vertical position. This prior art patent does not disclose or teach the design, structure and configuration of the improved convertible chair and ironing board apparatus of the present invention.

U.S. Pat. No. 1,982,111 to KING discloses a combination chair, ironing board and stepladder. The chair is transformable into an ironing board or stepladder from a chair orientation. The ironing board is used as a backrest and is movable from a vertical position to a horizontal position. The chair includes a front seat member and a rear seat member which cooperate with each other to form a complete chair seat. The rear seat member is pivotally movable from a horizontal position to a vertical position for supporting the ironing board in its horizontal position. Additionally, the chair includes various bracing elements for also supporting the ironing board in its horizontal position. This prior art patent does not disclose or teach the design, structure and configuration of the improved convertible chair and ironing board apparatus of the present invention.

None of the aforementioned prior art patents teach or disclose the features, design, configuration and structure of the improved convertible chair and ironing board including a frame housing having a back support section and a back support member that pivots relative to the back support section from a vertical position to a horizontal position in a 270° rotation about back support pivot points for transforming the back support member to a functioning ironing board. Further, none of the prior art disclose or teach a chair that includes a chair seat member having a movable seat section being movable from a horizontal position to a vertical position in a 90° rotation about seat pivot points to serve as a support member in order to hold a lower section of the back support member in a horizontal plane relative to the floor allowing the back support member to function as an ironing board.

Accordingly, it is an object of the present invention to provide an improved convertible chair and ironing board apparatus which is transformable from a straight back chair to a functioning ironing board for ironing of the user's clothes.

Another object of the present invention is to provide an improved convertible chair and ironing board apparatus that includes a frame housing having a back support section and a back support member that pivots relative to the back support section from a vertical position to a horizontal position in a 270° rotation about a pair of back support pivot points for transforming and converting the back support member to a functioning ironing board.

Another object of the present invention is to provide an improved convertible chair and ironing board apparatus that includes a chair seat member having a seat section being movable from a horizontal position to a vertical position in a 90° rotation about a pair of seat pivot points to serve as a support member in order to hold a lower section of the back support member in a horizontal plane relative to the floor allowing the back support member to function as an ironing board.

Another object of the present invention is to provide an improved convertible chair and ironing board apparatus that includes a storage compartment positioned under the chair seat member for storing of ironing paraphernalia such as a steam iron, spray starch, a water spray bottle and the like.

Another object of the present invention is to provide an improved convertible chair and ironing board apparatus that is a stable and sturdy horizontal platform and work surface for the ironing of clothes which eliminates any wobbling of the ironing board when in operational use.

Another object of the present invention is to provide an improved convertible chair and ironing board apparatus that includes an upholstered and padded covering for the ironing surface of the back support member when ironing clothes by the user.

Another object of the present invention is to provide an improved convertible chair and ironing board apparatus that is easy to assembly, easy to use; cleanable and durable for repeated use and longevity.

Another object of the present invention is to provide an improved convertible chair and ironing board apparatus that has a frame housing made from lightweight metals, moldable plastic, wood or combinations thereof.

A further object of the present invention is to provide an improved convertible chair and ironing board apparatus that can be mass-produced in an automated and economical manner and is readily affordable by the consumer.

SUMMARY OF THE INVENTION

In accordance with the present invention, there is provided a convertible chair and ironing board apparatus for transforming a straight-back chair into an ironing board. The convertible chair and ironing board apparatus includes a chair having a pair of front legs and a pair of rear legs for supporting a chair seat thereon. The chair seat has a storage compartment; the storage compartment is supported by the front legs and the rear legs; and the storage compartment is positioned below the chair seat. The convertible chair and ironing board apparatus also includes a back support section for receiving a back support member thereon; the back support member has an upper section and a lower section. The back support member is pivotally connected to the back support section about a pair of back support pivot members so that the back support member can rotatably pivot 270° from a vertical position as a back support for the chair to a horizontal position to function as an ironing board. The chair seat has a movable seat section that is pivotally connected to the chair seat about a pair of seat pivot members, and the seat section is movable from a horizontal seat position about the seat pivot members to a vertical support position for supporting the lower section of the back support member in a horizontal position to function as an ironing board.

BRIEF DESCRIPTION OF THE DRAWINGS

Further objects, features and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT

Figure 1:
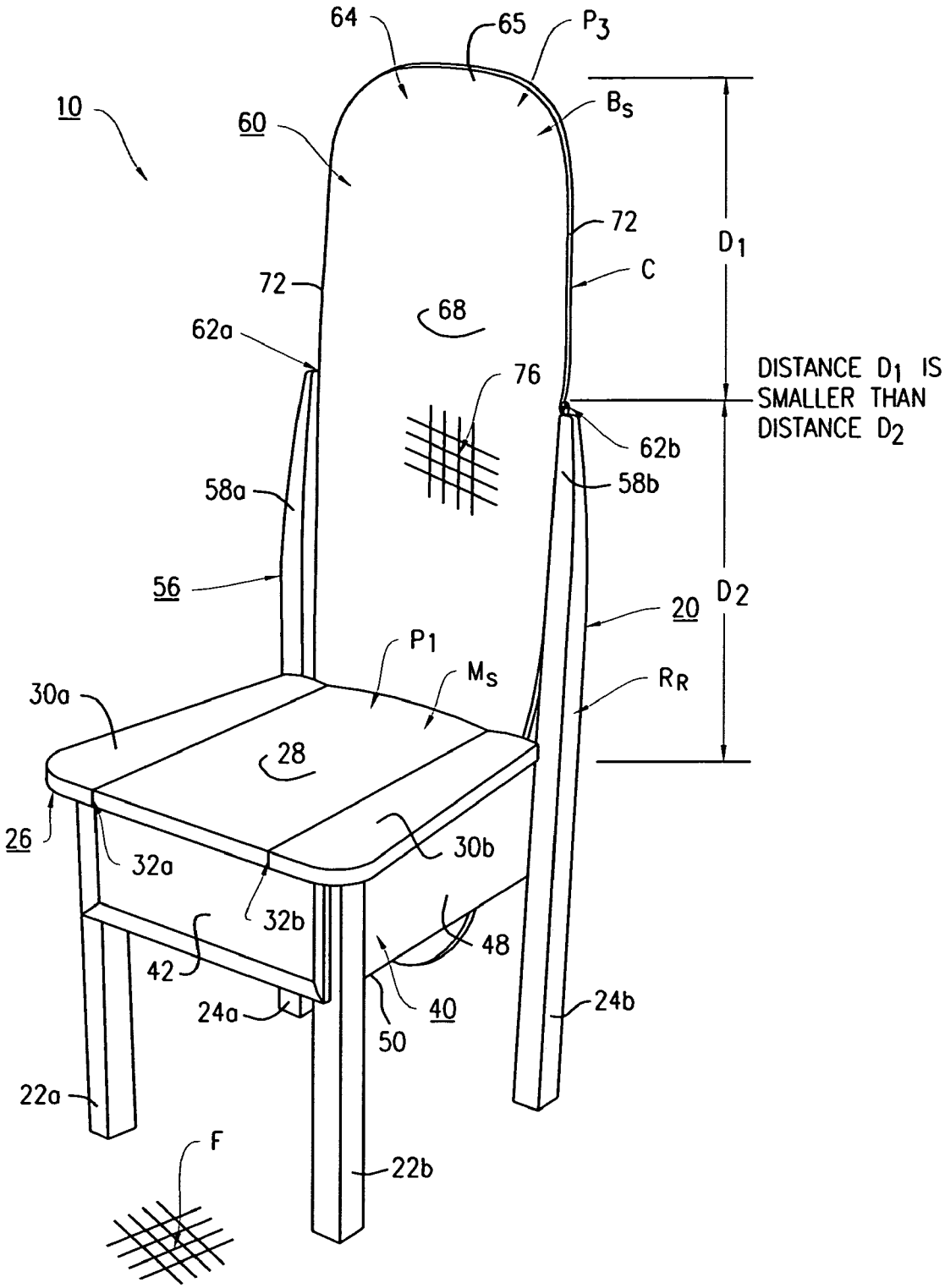
FIG. 1 is a front perspective view of the convertible chair and ironing board apparatus of the preferred embodiment of the present invention showing the chair's major component parts thereto.
Figure 5:
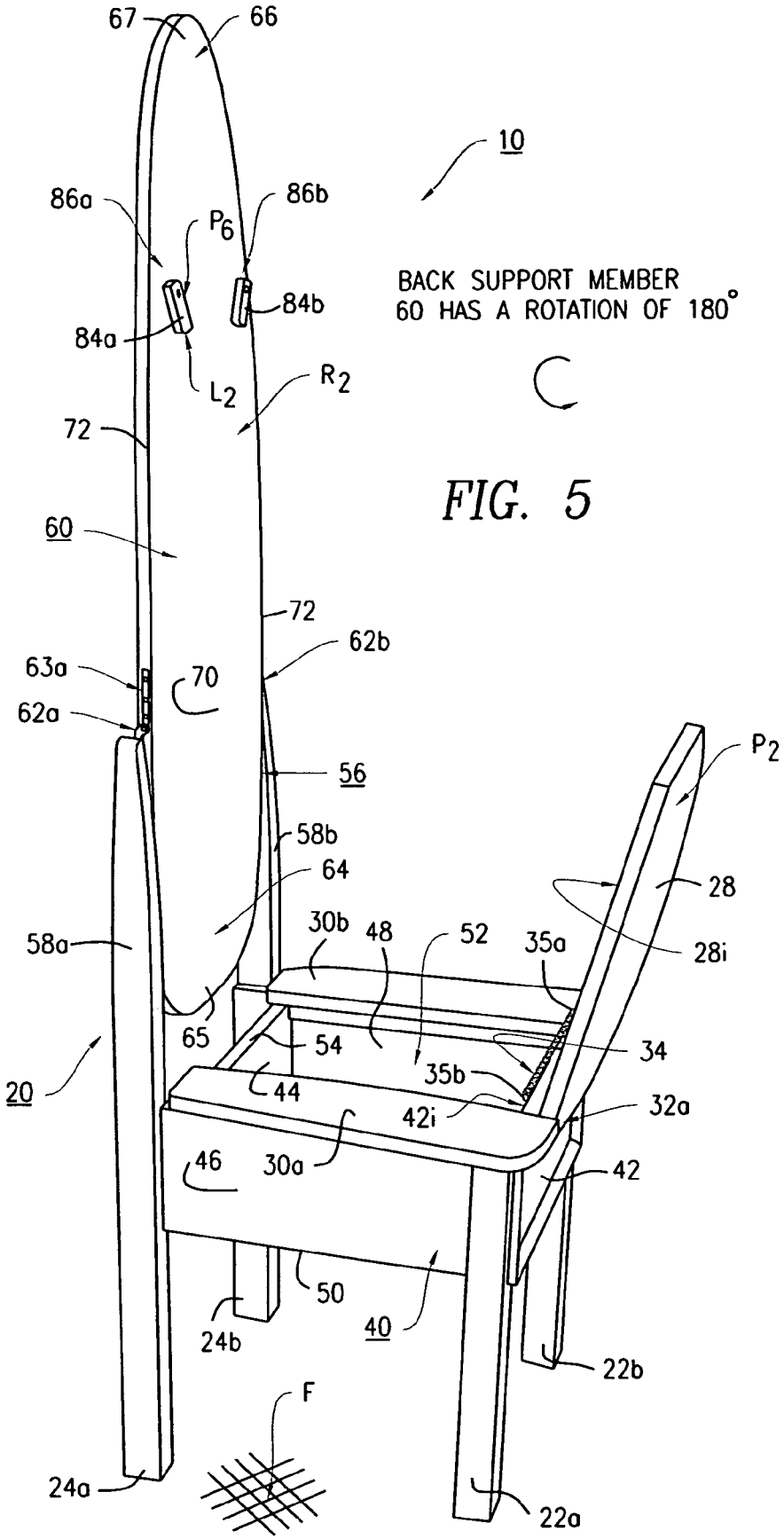
FIG. 5 is a rear perspective view of the convertible chair and ironing board apparatus of the present invention showing the back support member pivoting 180° relative to the back support section being in a vertical orientation with a padded ironing board side facing outwardly.
Figures 6, 6A:
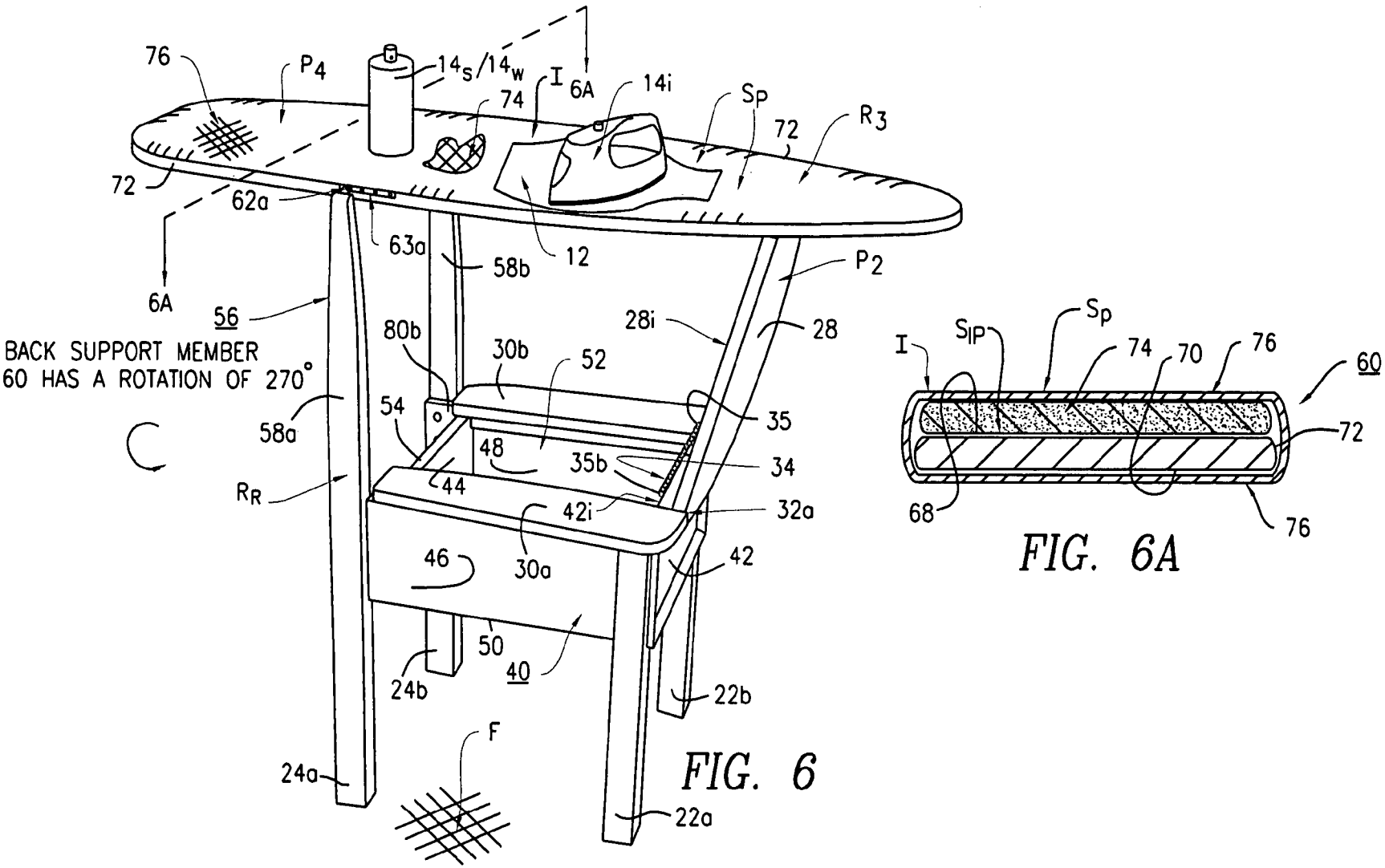
FIG. 6 is a rear perspective of the convertible chair and ironing board apparatus of the present invention showing the back support member pivoting 270° relative to the back support section being in a horizontal position to function as an ironing board and in its operational mode.
FIG. 6A is a cross-sectional view fo the convertible chair and ironing board apparatus of the present invention taken along lines 6A-6A of FIG. 6 in the direction of the arrows showing the back support member having a padding member and an upholstered fabric covering for forming a padded surface when ironing clothes.
Figure 7:
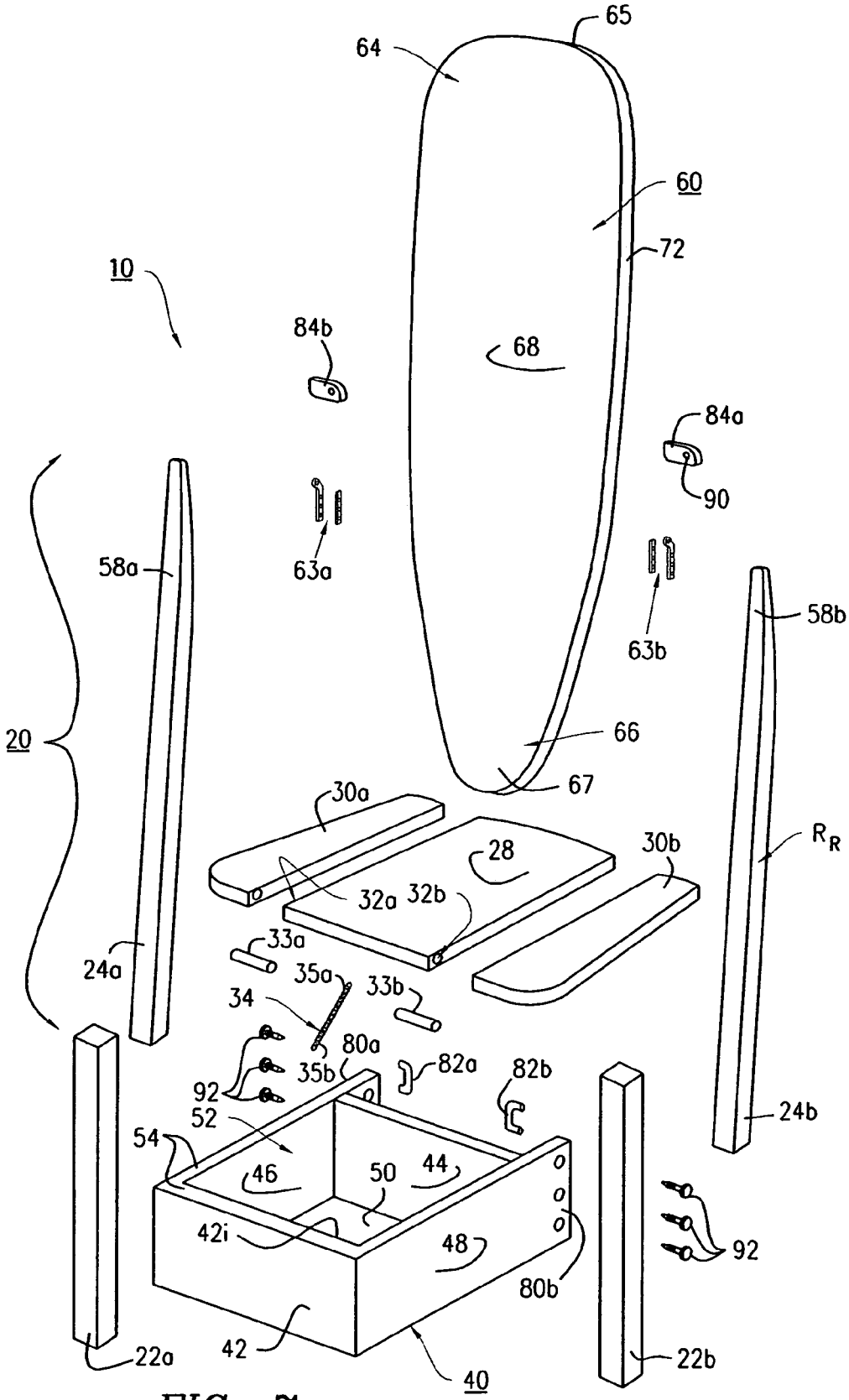
FIG. 7 is an exploded front perspective view of the convertible chair and ironing board apparatus of the present invention showing all of the major component parts thereto.

The convertible chair and ironing board apparatus 10 and its component parts of the preferred embodiment of the present invention are represented in detail by FIGS. 1 through 7 of the patent drawings. The convertible chair and ironing board apparatus 10 is transformable from a straight-back chair C to a functioning ironing board I for ironing of the user's clothes 12, as shown in FIGS. 1 and 7. The apparatus 10 has a frame housing 20 that can be made from durable, wear-resistant materials selected from the group consisting of lightweight metals such as aluminum, stainless steel and the like; moldable, rigid plastic materials; durable wood and wood composite materials such as oak, maple, birch and the like; and combinations thereof.

Figures 2, 2A:
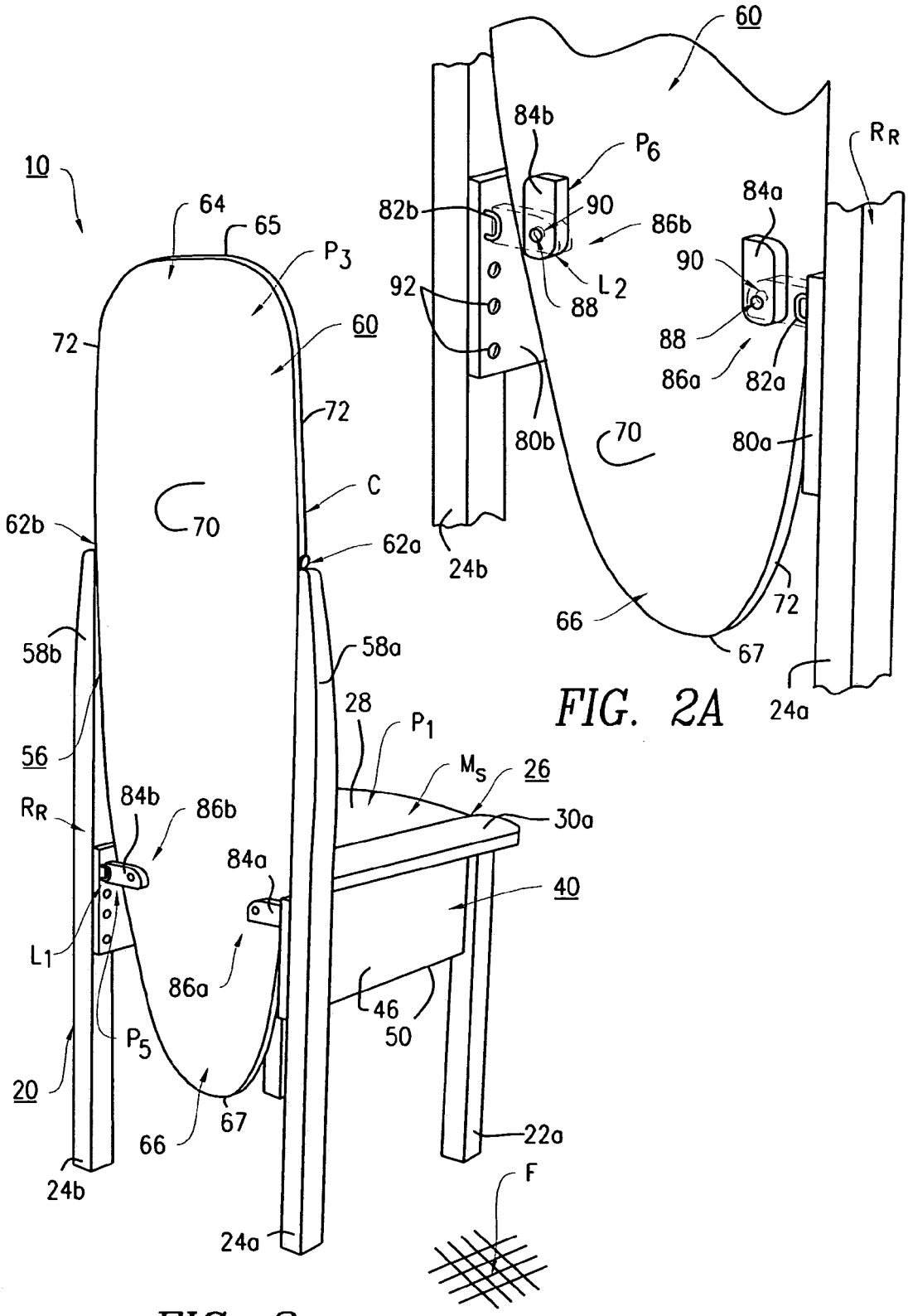
FIG. 2 is a rear perspective view of the convertible chair and ironing board apparatus of the present invention showing a chair seat having a movable seat section, a back support member pivotally connected to a back support section, and a pair of front legs and a pair of rear legs for supporting the chair seat thereon.
FIG. 2A is an enlarged rear perspective view of the convertible chair and ironing board apparatus of the present invention showing the back support member in an unlocked vertical position using a pair of pivoting holding locking members being detachably connected to the back support member of the chair.
Figure 3:
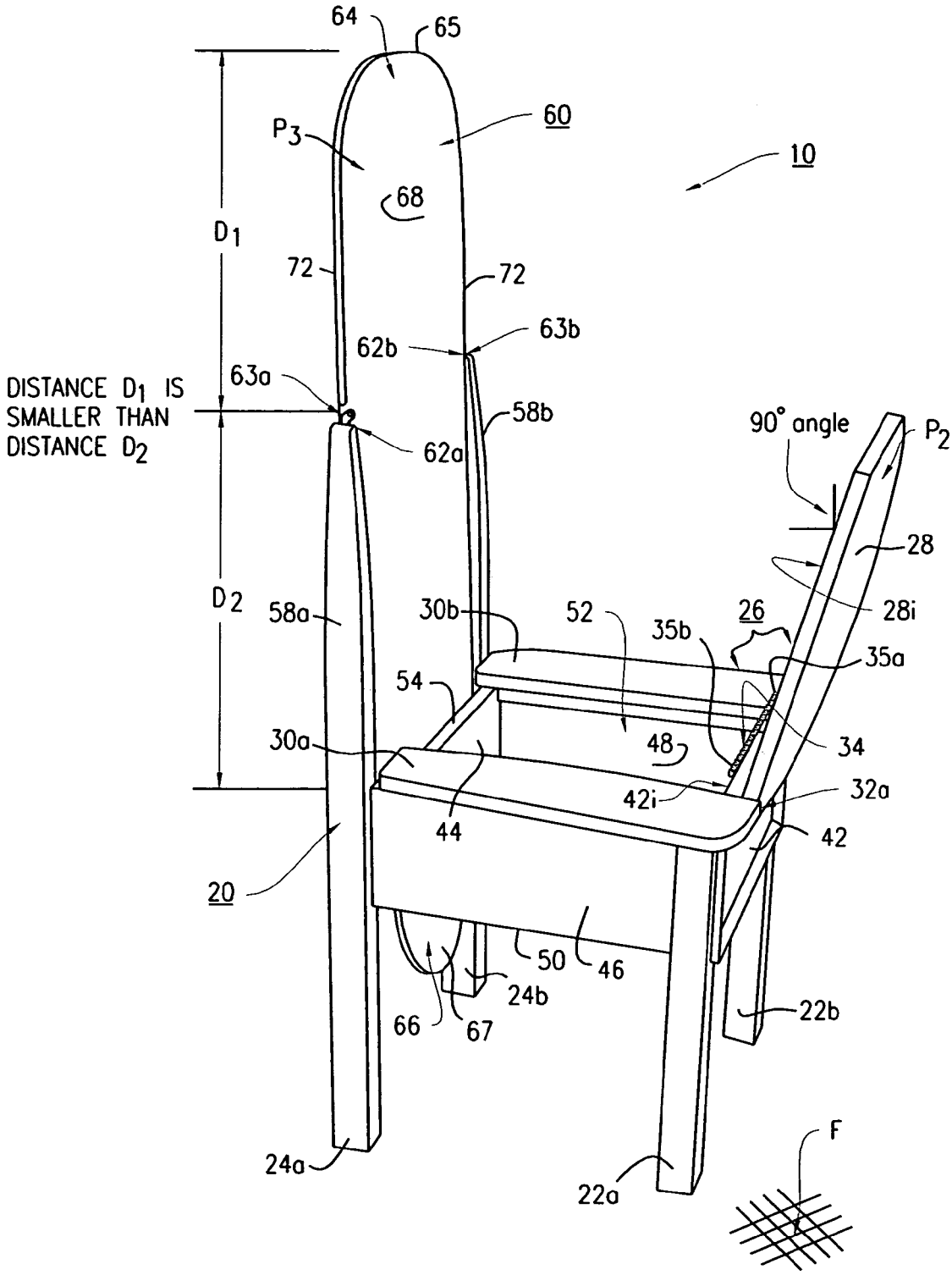
FIG. 3 is a front perspective view of the convertible chair and ironing board apparatus of the present invention showing the movable seat section in a vertical position relative to the horizontal chair seat.

As shown in FIGS. 1, 2, 2A and 7, the convertible chair and ironing board apparatus includes a frame housing 20 having a pair of front legs 22*a* and 22*b* and a pair of rear legs 24*a* and 24*b* for supporting a chair seat member 26 thereon. The chair seat member 26 includes a movable seat section 28 pivotally connected to a pair of opposing stationary seat sections 30*a* and 30*b* about a pair of seat pivot points or members 32*a* and 32*b*. The frame housing 20 further includes a storage compartment 40 being supported by the front and rear legs 22*a*, 22*b*, 24*a* and 24*b*, respectively. The storage compartment 40 is positioned and located below the chair seat 26, as depicted in FIGS. 1 and 2. The storage compartment 40 includes a front wall 42, a rear wall 44, side walls 46 and 48, a bottom wall 50 for forming an interior storage compartment 52 for holding of ironing paraphernalia such as a steam iron 14*i*, spray starch 14*s*, or a water spray bottle 14*w* and the like. The storage compartment 40 also includes an upper perimeter edging 54 for supporting of the seat sections 30*a*, 28 and 30*b*, respectively, of chair seat member 26 thereon, as shown in FIGS. 1 and 2 of the drawings. The seat section 28 of the chair seat member 26 is movable from a horizontal position $P_1$ to a vertical position $P_2$ in a 90° rotation about the pair of seat pivot points 32*a* and 32*b*, respectively, to serve as a support member $M_S$ in order to hold a lower section 66 of a back support member 60 in a horizontal plane $P_4$ relative to the floor F allowing the back support member 60 to function as an ironing board I, as shown in FIG. 6 of the drawings. Seat pivot members 32*a* and 32*b* are in the form of pivot bars 33*a* and 33*b*, as shown in FIG. 7 of the drawings, respectively. The movable seat section 28 is held at the 90° position by holding means 34 having ends 35*a* and 35*b*, such that one end 35*a* of a chain 34 is attached to an underside 28*i* of seat section 28 and the other end 35*b* of the chain 34 is attached to an interior front wall surface 42*i* of front wall 42, as shown in FIG. 3 and 6 of the drawings. The holding means 34 can be in the form of a chain, a plastic strap, a flexible wire, a leather strip, a string, a cord or combinations thereof.

Figure 4:
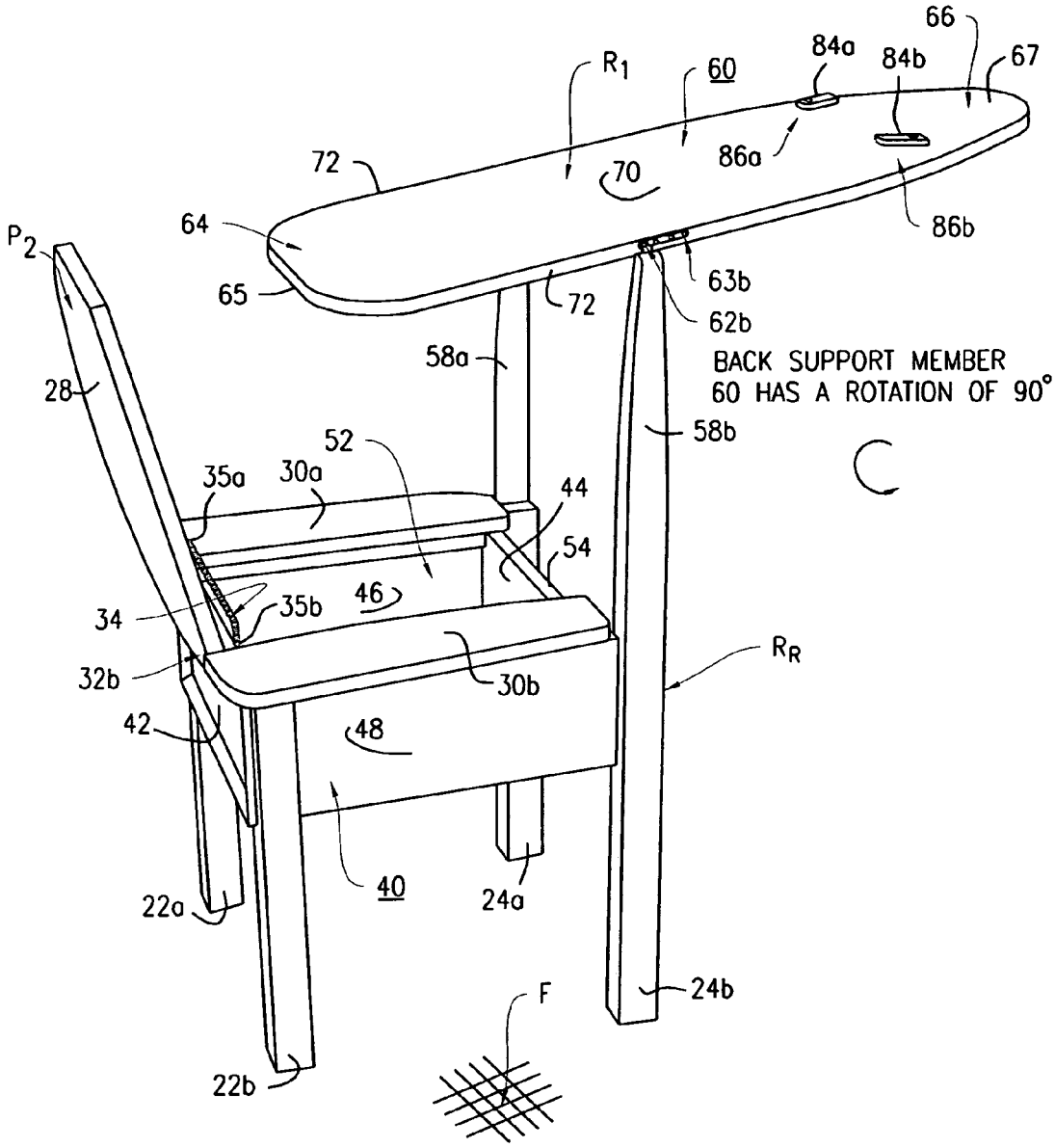
FIG. 4 is a rear perspective view of the convertible chair and ironing board apparatus of the present invention showing the back support member pivoting 90° relative to the back support section being in a horizontal orientation with an unpadded side facing upwardly.

The frame housing 20 also includes a back support section 56 being integrally connected with each of the rear legs 24*a* and 24*b*, as shown in FIGS. 2, 2A and 4 of the drawings. The back support section 56 includes a pair of opposing rail members 58*a* and 58*b* for receiving a back support member 60 therebetween. Rail members 58*a* and 58*b* and rear legs 24*a* and 24*b* are integrally connected into a single unitary support column $R_R$. The back support member 60 is pivotally connected to each of the opposing rail members 58*a* and 58*b* on the back support section 56 about a pair of back support pivot points or members 62*a* and 62*b*, respectively, such that the back support member 60 can pivot 270° from a vertical position $P_3$ as a back support Bs for chair C to a horizontal position $P_4$ to function as an ironing board I. Back support pivot members 62*a* and 62*b* are in the form of pivot hinges 63*a* and 63*b*, as shown in FIG. 7 of the drawings, respectively. The back support member 60 includes an upper section 64 having an upper end 65 and a lower section 66 having a lower end 67. The back support member 60 also includes a first side 68, a second side 70 and a perimeter edge 72. The first side 68 is used as the ironing board surface $S_{IB}$ (see FIG. 6A) when in the operational mode. The first side 68 of the back support member 60 includes a padding member 74 being used as a padded surface $S_P$ when ironing clothes 12, as shown in FIGS. 6 and 6A of the drawings. The first and second sides 68 and 70 and the perimeter edge 72 of the back support member 60 includes an upholstered fabric covering 76 made from fire-resistant materials. The upholstered fabric covering 76 can be made in an array of vibrant colors, patterns and designs.

As shown in FIGS. 2 and 2A, the frame housing 20 further includes a pair of opposing mounting end sections 80*a* and 80*b* extending from side walls 46 and 48, respectively. Mounting end sections 80*a* and 80*b* are integrally attached to the opposing rear legs 24*a* and 24*b* and to opposing ends 45*a* and 45*b* of an exterior rear wall surface 44*e* of rear wall 44 on storage compartment 40. Each of mounting end sections 80*a* and 80*b* include a holding bar member 82*a* and 82*b* for detachably receiving a rotatable holding locking member 84*a* and 84*b* thereto, respectively. The rotatable holding locking members 84*a* and 84*b* are pivotally mounted to opposing side sections 86*a* and 86*b* adjacent to opposing perimeter edges 72 (see FIG. 2A) using a pivoting bolt member 88 within a bolt opening 90. Mounting end sections 80*a* and 80*b* also give further structural stability to each of the rear legs 24*a* and 24*b* and to the rear wall 44 of storage compartment 40. Mounting end sections 80*a* and 80*b* are attached to the rear legs 24*a* and 24*b* and to opposing ends 45*a* and 45*b* of rear wall 44 by screws 92, glue, adhesive, cement, welding, staples or combinations thereof. Each of the rotatable holding locking members 84*a* and 84*b* when in a horizontal orientation $P_5$ is in a locked position $L_1$ for keeping the back support member 60 in its vertical position $P_3$ for use as the back support $B_S$ for the chair C (see FIGS. 2 and 2A). Each of the rotatable holding locking members 84*a* and 84*b* when in a vertical orientation $P_6$ is in an unlocked position $L_2$ in preparation for pivotally rotating the back support member 60 the 270° rotation about the back support pivot members 62*a* and 62*b*, as depicted in FIGS. 2A, and 3 to 6 of the drawings.

Additionally, as shown in FIGS. 4, 5 and 6, the distance between the upper end 65 of the upper section 64 of back support member 60 and the back support pivot points 62*a* and 62*b* defines a first distance $D_1$; and the distance between the back support pivot points 62*a* and 62*b* and the chair seat member 26 defines a second distance $D_2$. The second distance $D_2$ is greater than the first distance $D_1$, so that the upper end 65 of the back support member 60 can pivot 270° and pass through the space defined by the second distance $D_2$ to allow the back support member 60 to also function as an ironing board I.

Operation of the Present Invention

As shown in FIGS. 1, 2A, and 3 to 6, the convertible chair and ironing board apparatus 10 operates in the following manner to convert the straight-back chair $C_1$ to a functioning ironing board I: The user initially opens and moves the seat section 28 of chair seat member 26 from a horizontal position $P_1$ to a vertical position $P_2$ (see FIGS. 1 and 3) in a 90° rotation about the pair of seat pivot members 32*a* and 32*b*, respectively, to serve as a support member $M_S$ in order to hold a lower section 66 of back support member 60 in a horizontal plane $P_1$ relative to the floor F allowing the back support member to function as an ironing board I. The movable seat section 28 is then held at a 90° position by the chain member 34 attached to the underside 28*i* of seat section 28 and the interior front wall surface 42*i* of front wall 42 of storage compartment 40.

The user next moves each of the rotatable holding locking members 84*a* and 84*b* from a locked position $L_1$ (tab members are in a horizontal orientation) to an unlocked position $L_2$ (tab members are in a vertical orientation) in order to pivotally rotate the back support member 60 about the back support pivot members 62*a* and 62*b* within the back support section 56 from its vertical position $P_3$ as a back support $B_S$ for chair C (see FIG. 1) to a first rotating position $R_1$ (horizontally oriented), as shown in FIG. 4, where the back support member has rotated 90° from its original vertical position $P_3$ (see FIG. 3). The user continues to rotate the back support member 60 another 90° (see FIG. 5), such that the back support member 60 has now rotated 180° and the (underside) second side 70 of back support member 60 is facing inwardly towards the vertically positioned $P_2$ movable seat section 28, as shown in FIG. 5, to a second rotating position $R_2$. The user now continues to rotate the back support member 60 another 90° (see FIG. 6), such that the back support member 60 has finally rotated 270° and the second side 70 of lower section 66 of back support member 60 is resting on the vertically positioned $P_2$ movable seat section 28, as shown in FIG. 6 of the patent drawings, to its final rotating position $R_3$. The foregoing mechanism for the 270° rotation is accomplished by having the upper end 65 of the upper section 64 of back support member 60 being disposed between the back support pivot members 62*a* and 62*b* such that the upper end 65 of the back support member 60 defines a first distance $D_1$; and the distance between the back support pivot members 62*a* and 62*b* and the chair seat member 26 defines a second distance $D_2$. The second distance $D_2$ is greater than the first distance $D_1$ such that the upper end 65 of the back support member 60 can pivot and pass through the space defined by the second distance $D_2$ to allow the back support member 60 to function as an ironing board I.

In summary, the back support member 60 pivots relative to the back support section 56 from a vertical position $P_3$ to a horizontal position $P_4$ in a 270° rotation about the pair of back support pivot members 62*a* and 62*b* on rail members 58*a* and 58*b*, respectively, for transforming and converting the back support member 60 to a functioning ironing board I. The ironing board I is now in an operational mode for the ironing of clothes 12 by a steam iron 14*i*, as depicted in FIG. 6.

When the apparatus 10 is no longer needed the user simply reverses the above aforementioned steps and converts the ironing board I to a straight back chair C, as shown in FIGS. 6 and 1, respectively.

Advantages of the Present Invention

Accordingly, an advantage of the present invention is that it provides for an improved convertible chair and ironing board apparatus which is transformable from a straight-back chair to a functioning ironing board for ironing of the user's clothes.

Another advantage of the present invention is that it provides for an improved convertible chair and ironing board apparatus that includes a frame housing having a back support section and a back support member that pivots relative to the back support section from a vertical position to a horizontal position in a 270° rotation about a pair of back support pivot points for transforming and converting the back support member to a functioning ironing board.

Another advantage of the present invention is that it provides for an improved convertible chair and ironing board apparatus that includes a chair seat member having a seat section being movable from a horizontal position to a vertical position in a 90° rotation about a pair of seat pivot points to serve as a support member in order to hold a lower section of the back support member in a horizontal plane relative to the floor allowing the back support member to function as an ironing board.

Another advantage of the present invention is that it provides for an improved convertible chair and ironing board apparatus that includes a storage compartment positioned under the chair seat member for storing of ironing paraphernalia such as a steam iron, spray starch, a water spray bottle and the like.

Another advantage of the present invention is that it provides for an improved convertible chair and ironing board apparatus that is a stable and sturdy horizontal platform and work surface for the ironing of clothes which eliminates any wobbling of the ironing board when in operational use.

Another advantage of the present invention is that it provides for an improved convertible chair and ironing board apparatus that includes an upholstered and padded covering for the ironing surface of the back support member when ironing clothes by the user.

Another object of the present invention is that it provides for an improved convertible chair and ironing board apparatus that is easy to assembly, easy to use; cleanable and durable for repeated use and longevity.

Another advantage of the present invention is that it provides for an improved convertible chair and ironing board apparatus that has a frame housing made from lightweight metals, moldable plastic, wood or combinations thereof.

A further advantage of the present invention is that it provides for an improved convertible chair and ironing board apparatus that can be mass-produced in an automated and economical manner and is readily affordable by the consumer.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A convertible chair and ironing board for transforming a straight-back chair into an ironing board, comprising:

a) a chair having a pair of front legs and a pair of rear legs for supporting a chair seat thereon; said chair seat having a front edge;

b) said chair seat having a storage compartment with a rear wall; said storage compartment being supported by said front legs and said rear legs; and said storage compartment being positioned below said chair seat;

c) a back support section for receiving a back support member thereon; said back support member having an upper section and a lower section;

d) said back support member being pivotally connected to said back support section about a pair of back support pivot members so that said back support member can rotatably pivot 270° from a vertical position as a back support for said chair to a horizontal position to function as an ironing board; and e) said chair seat having a movable seat section being pivotally connected to said chair seat about a pair of seat pivot points, said pair of seat pivot points being located at said front edge of said chair seat; and said seat section being movable from a horizontal seat position about said seat pivot points at said front edge to a vertical support position for supporting said lower section of said back support member in a horizontal position to function as an ironing board.

2. A convertible chair and ironing board in accordance with claim 1, wherein said upper section of said back support member has an upper end of said back support member such that the distance between said back support pivot members and said upper end of said back support member defines a first distance; and the distance between said back support pivot members and said chair seat defines a second distance, which is greater than said first distance, so that said upper section of said back support member can pivot and pass through the space defined by said second distance to allow said back support member to pivot 270° to said horizontal position to allow said back support member to function as an ironing board.

3. A convertible chair and ironing board in accordance with claim 1, wherein said storage compartment includes a front wall, a rear wall, side walls, a bottom wall and a perimeter edging for forming an interior storage compartment for holding of ironing paraphernalia therein such as a steam iron, spray starch, and a water spray bottle.

4. A convertible chair and ironing board in accordance with claim 3, wherein said chair seat member is in contact with and adjacent to said perimeter edging of said storage compartment.

5. A convertible chair and ironing board in accordance with claim 1, wherein said movable seat section is centrally positioned between a pair of opposing stationary seat sections of said chair seat member.

6. A convertible chair and ironing board in accordance with claim 1, wherein said movable seat section is held at a 90° vertical position by holding means relative to said storage compartment.

7. A convertible chair and ironing board in accordance with claim 6, wherein said holding means are in the form of a chain.

8. A convertible chair and ironing board in accordance with claim 6, wherein said holding means has a first and a second end; said first end is attached to an underside wall surface of said movable seat section and said second end is attached to an interior front wall surface of said front wall of said storage compartment.

9. A convertible chair and ironing board in accordance with claim 1, wherein each of said rear legs and opposing ends of an exterior rear wall surface of said rear wall of said storage compartment include mounting end sections attached thereto for providing additional structural stability to each of said rear legs.

10. A convertible chair and ironing board in accordance with claim 9, wherein each of said mounting brackets includes a holding bar member.

11. A convertible chair and ironing board in accordance with claim 1, wherein said back support member includes a first side, a second side and a perimeter edge.

12. A convertible chair and ironing board in accordance with claim 1, wherein said back support section includes a pair of opposing rail members for receiving said back support member therebetween.

13. A convertible chair and ironing board in accordance with claim 12, wherein said back support member is pivotally connected to each of said opposing rail members about each of said back support pivot members.

14. A convertible chair and ironing board in accordance with claim 11, wherein said second side of said back support member has pivotally mounted thereon a pair of opposing rotatable locking members for locking said back support member in a vertical position.

15. A convertible chair and ironing board in accordance with claim 14, wherein each of said locking members engage said holding bar members for locking said back support member in a vertical position.

16. A convertible chair and ironing board in accordance with claim 11, wherein said first side of said back support member includes a padding member being used as a padded surface when ironing clothes on said first side.

17. A convertible chair and ironing board in accordance with claim 16, wherein said padding member on said first side, said second side and said perimeter edges of said back support member are covered by a detachably connected fabric covering.

18. A convertible chair and ironing board in accordance with claim 1, wherein said chair includes a frame housing made from durable, wear-resistant materials selected from the group consisting of lightweight metals such as aluminum or stainless steel; moldable, rigid plastic materials; durable wood and wood composite materials such as oak, maple, birch and combinations thereof.

19. A convertible chair and ironing board in accordance with claim 12, wherein each of said rear legs and each of said rail members are integrally connected together as a single piece.

20. A convertible chair and ironing board in accordance with claim 1, wherein each of said back support pivot members are in the form of pivot hinges.

* * * * *